US006003247A

United States Patent [19]

Steffe

[11] Patent Number: 6,003,247

[45] Date of Patent: Dec. 21, 1999

[54] ANTI-STATIC BOOT HAVING A CONDUCTIVE UPPER

[76] Inventor: Daniel D. Steffe, 2431 4th St., White Bear Lake, Minn. 55110

[21] Appl. No.: 08/862,532

[22] Filed: May 23, 1997

[51] Int. Cl.[6] ..... A43B 23/00; H05F 3/00

[52] U.S. Cl. ..... 36/45; 361/223

[58] Field of Search ..... 361/223, 224; 36/1, 25 R, 30 R, 32 R, 45

[56] References Cited

U.S. PATENT DOCUMENTS

| | | | |
|---|---|---|---|
| 3,383,559 | 5/1968 | Oesterheld | 361/224 |
| 3,459,997 | 8/1969 | Legge | 361/223 |
| 3,541,389 | 11/1970 | Van Name | 361/224 |
| 3,912,973 | 10/1975 | Young | 361/223 |
| 4,596,053 | 6/1986 | Cohen et al. | 2/1 |
| 4,812,948 | 3/1989 | Bird et al. | 361/223 |
| 5,184,275 | 2/1993 | Wiegel et al. | 361/223 |
| 5,191,505 | 3/1993 | Gordon et al. | 361/223 |
| 5,448,840 | 9/1995 | Cheskin | 36/32 R |
| 5,576,924 | 11/1996 | Hee | 361/223 |

OTHER PUBLICATIONS

Johnson et al., "A Study on the Effectiveness of ESD Smocks", *EOS/ESD Symposium Proceedings,* 263–267 (1990).

Worklon Specal Purpose Apparel Catalog, 2–27, Copyright 1992 Superior Surgical Mfg. Co., Inc.

Apparel Solutions for All Works of Life, Editiion II, Red Kap Industries, 63, 80–84, Updated Jun. 1995.

*Primary Examiner*—B. Dayoan

*Attorney, Agent, or Firm*—Merchant, Gould, Smith, Edell, Welter & Schmidt, P.A.

[57] ABSTRACT

A boot has an upper portion and a sole. The sole has upper and lower surfaces, and provides an electrical path from the upper surface to the lower surface. An insert has an H-shaped portion in electrical communication with the upper surface of the sole and a tail. The tail can be connected to the leg of coveralls. Electric charges can flow between the tail and the boot sole.

15 Claims, 2 Drawing Sheets

ANTI-STATIC BOOT HAVING A CONDUCTIVE UPPER

TECHNICAL FIELD

The present invention relates to protective boots, and more particularly to boots configured to provide a path to an electrical ground.

BACKGROUND

Semiconductor devices and disk drive heads have developed to the point where they are sensitive to the slightest charge, even charges as low as 5 volts. This sensitivity is problematic because it is very difficult to create an environment that is isolated from all static electricity and other charges. To complicate matters, most static charges will radiate a field having a radius as large as two feet. As a result, a charge on a person's arm or torso can damage a device on which they are working. The problem is so severe that up to 35% of the devices are irreparably damaged in some manufacturing facilities.

In an effort to eliminate this problem, these types of devices are manufactured in clean rooms that are specially designed to minimize static electricity. The workers typically wear grounding straps to provide an electrically conductive path to dissipate static charges. The workers also wear special coveralls that are also grounded.

Some clean rooms where semiconductor devices and disk drive heads are manufactured have a grounded floor that will dissipate electrical charges. Many workers rely on this floor to provide a ground for both their body and their coveralls. In this type of environment, the workers wear a boot that has a conductive bottom. Any charge in the boot will be conducted to the grounded floor and dissipated. The problem is that many workers also wear shoes having rubber soles in their boots. As a result, the worker's body is insulated from the floor and is not grounded. Another problem is that the coverall legs are stuffed in the boot's cuff and there is only incidental contact between the coverall and the boot. This incidental contact does not provide a reliable electrical path having a low resistance. The coveralls thus are not adequately grounded and may retain a harmful static charge.

Therefore, there is a need for an improved boot configured to have a reliable electrical contact with the worker's body. There is also a need for a boot configured to have a reliable electrical contact with the worker's coveralls.

SUMMARY

The present invention is directed to a boot comprising an upper portion. A sole has upper and lower surfaces. The sole is operably connected to the upper portion and is configured to provide an electrical path from the upper surface to the lower surface. An insert has a first portion in electrical communication with the upper surface of the sole and a second portion configured to project upward from the upper surface of the sole.

DETAILED DESCRIPTION

Figure 1:
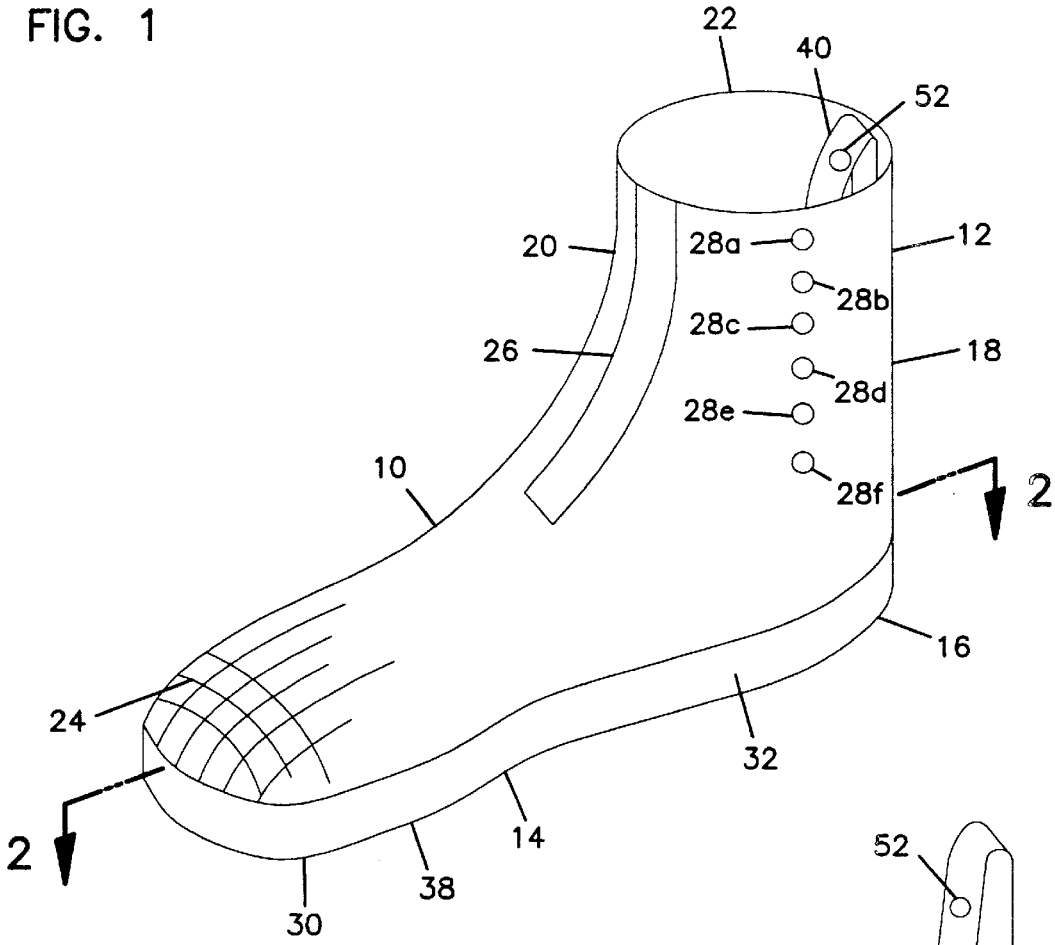
FIG. 1 is a perspective view of a boot embodying the present invention partially showing a grid of conductive wires woven into the fabric of the upper.

The present invention will be initially described in general terms. Various embodiments of the present invention, including the preferred embodiment, then will be described in detail with reference to the drawings wherein like reference numerals represent like parts and assemblies throughout the several views. Reference to the described embodiments is not meant to limit the scope of the invention, which is limited only by the scope of the appended claims.

In general terms, the present invention relates to a boot having an electrically conductive insert. The insert has a lower portion that lies along the top surface of the boot's sole and an upper portion that extends upward from the boot's sole. The upper portion is configured and sized so that it can extend into a person's shoe. This configuration provides an electrical path between the person and the boot's sole. One possible embodiment has a snap on the upper portion so that the insert can be snapped to the leg of coveralls. The snap is formed from an electrically conductive material and provides an electrical path between the coverall and the boot's sole.

This invention has several advantages. For example, it provides a constant and reliable electrical path having a relatively low resistance between the person and the boot's sole. In one possible embodiment, for example, the resistance is below $4\times10^7$ ohms at 500 volts, $5\times10^7$ ohms at 100 volts, and $8\times10^8$ ohms at 100 volts. These levels of resistance provide a relatively quick discharge of static electricity and other charges without causing any sparks that result when there is a direct ground. Such sparks increase the likelihood that the charge will damage the semiconductor or magnetic device on which the person comes into contact.

Another advantage is that a person working in a clean room, or other electrically sensitive environment, can be grounded to the floor at all times. This grounding provides a path for the safe and harmless discharge of electrical charges such as static electricity that is separated from a bench top or other elevated work area. A related advantage is that a worker who is wearing a grounding strap at a work station can disconnect the strap and freely move to another area while still remaining grounded. This invention may even permit the person to safely work in an electrically sensitive area without being connected to a grounding strap at all. If a snap is positioned on the insert for connection to coveralls, the present invention has a further advantage in that it will also provide a constant and reliable electrical path between the coveralls and the boot's sole.

Although the present invention is primarily described for use in a clean room, it could be used in other applications as well. For example, the present invention could be used in boots worn by workers involved with electrostatic painting, which is common in the automobile industry.

Referring now to FIG. 1, a boot 10 has an upper 12, a sole 14, a heel portion 16, and a rear edge 18. The upper 12 has a cuff portion 20 that is configured to extend up a person's leg. A top edge 22 of the cuff portion 20 extends about 21 inches to about 33 inches above the sole 14. An advantage of having the cuff 20 extend so high is that the leg of anti-static coveralls (not shown) can fit securely inside the cuff 20. The upper 12 is formed from a single piece of polyester material that has a grid 24 of carbon-suffused threads woven throughout the fabric. Carbon-suffused thread is a thread having a carbon sleeve or cladding around a core of polyester, nylon, or other suitable material. The carbon-suffused nylon thread provides an electrical path for any electrical charges that are on the fabric. The fabric is of the type manufactured by Tejiin, Ltd. of Yokohama, Japan One possible configuration of the boot 10 has a plastic zipper (not shown) covered by a protective flap 26. The zipper provides for ease of slipping the boot on and off. Seams for the zipper and protective flap 26 are sewn with carbon thread, which is a multi-strand thread in which at least one of the strands is formed from carbon. Other possible configurations of the boot 10 do not have a zipper.

The boot 10 has six snaps 28*a*–28*f* extending upward along a vertical line. The snaps 28*a*–28*f* are made from an electrically conductive material such as stainless steel and are fastened so that they are in electrical contact with the grid 24 of carbon-suffused nylon thread that is woven into the upper 12. The legs of the coveralls also has six vertically oriented snaps (not shown). In use, some of the snaps 28*a*–28*f* on the boot 10 are connected to the snaps on the leg of the coverall. This connection provides an electrical path between the coveralls and the boot 10. Although not required, having at least two snaps connected between the boot 10 and the coveralls provides a redundant path in case one snap inadvertently becomes disconnected and ensures that there is an adequate electrical path provided between the coveralls and the boot 10. Having six snaps on both the boot 10 and the coverall leg also provides adequate adjustments to accommodate people of various height and size.

Figure 2:
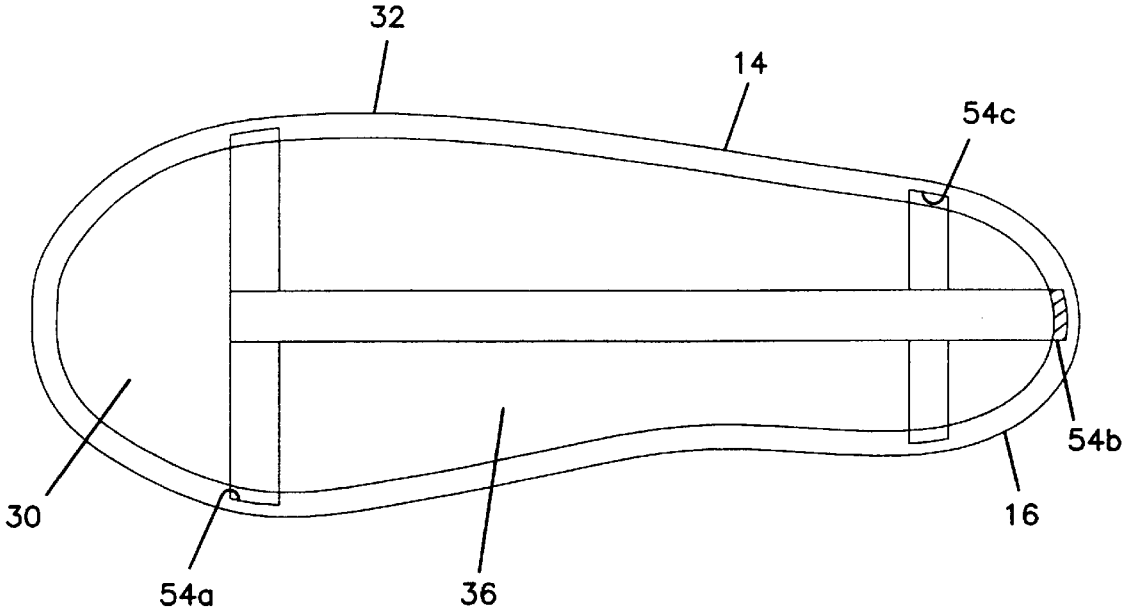
FIG. 2 is a top view of the sole of the boot illustrated in FIG. 1 taken along line 2—2.

Referring now to FIGS. 1 and 2, the sole 14 has a bottom 30 and a continuous side wall 32. The continuous side wall 32 has a height of about 1 inch. The bottom has inner and outer surfaces 36 and 38. The sole 14 is molded from an electrically conductive or anti-static plastic material such as Chemstat 939™ brand material. One possible source for the soles 14 is Stern & Stern, Inc. of New York City, N.Y. The upper 12 is sewn to the sole 14 with carbon thread. The carbon thread is in electrical contact with the grid 24 of carbon-infused thread in the upper 12. In this configuration, the carbon thread provides an electrical path between the upper 12 and the sole 14.

Figure 3:
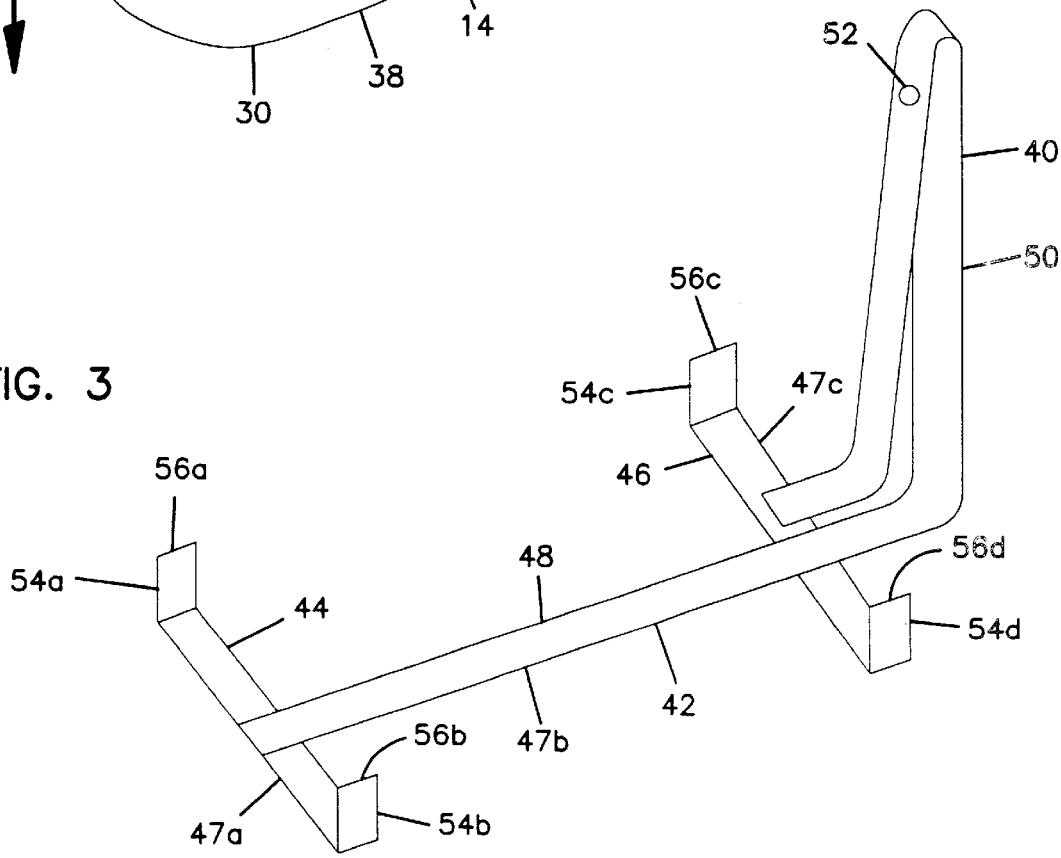
FIG. 3 is a perspective view of an electrically-conductive insert positioned within the boot illustrated in FIG. 1.

Referring now to FIGS. 1–3, the boot 10 also has an insert 40. The insert 40 has an H-configuration with an elongated strip 42, a front cross-member 44, and a rear cross-member 46. The insert 40 is formed from carbon strips 47*a*–47*c*, which are strips of material woven with carbon strands. One possible source of the carbon strips is Patlon Industries of Miami, Fla. The elongated strip 42 has a lower portion 48 that extends along the inner surface 36 of the sole 14 and a tail portion 50 positioned proximal to a rear edge 18 of the boot 10.

The lower portion 48 of the elongated strip 42 lies across, and is sewn to, the front and rear cross-members 44 and 46. Carbon thread is used for the stitching. The tail portion 50 has sufficient length to extend upward along the rear edge 18 of the boot 10, back down into a person's shoe, and at least partially along the bottom of their foot. In one possible embodiment, the tail 50 has a length between about 32 to about 33 inches long. A stainless steel snap 52 is mounted on the tail portion 50 and is positioned about 16 inches from the boot sole 14.

Additionally, each cross-member 44 and 46 has oppositely disposed end portions 54*a*–54*d* that extend upward along the side wall of the sole and oppositely disposed tips 56*a*–56*d*. Each cross section 44 and 46 is sewn to the side wall 32 of the sole 14 adjacent to the tips 56*a*–56*d* and about 1 inch above the inner surface 36 of the sole 14. Carbon thread is used for the stitching. No other area of the insert 40 is sewn to the sole 14 so that the insert 40 essentially floats along the inner surface 36 of the sole 14. An advantage of this configuration is stitching along the bottom 30 of the sole 14 would provide a pressure point while the person was walking or standing and result in premature wear of the boot 10. This configuration prevents premature wear.

In an alternative configuration, the portion of the tail 50 that extends upward along the rear edge 18 of the boot 10 has adhesive or a snap that adheres to the fabric of the upper 12. This configuration is advantageous because it keeps the tail 50 permanently positioned along the rear edge 18 of the boot 10, which makes it easier for a person to find and grab the tail 50 when they are putting the boot 10 on their foot. In another possible configuration, the cross-members 44 and 46 are attached to the sole 14 with an electrically-conductive adhesive or snap rather than stitching.

The distance between the cross-members 44 and 46 is about 70% or more of the overall length of the boot sole 14. In this configuration, the cross-members 44 and 46 are separated by about 5.5 inches to about 6 inches for an extra-small boot; about 6 inches to about 6.5 inches for a small boot; about 7 inches to about 7.5 inches for a medium boot; about 8 inches to about 8.5 inches for a large boot; and about 8.5 inches to about 9 inches for an extra-large boot. Additionally, the rear cross-member 46 is positioned about 0.5 inch to about 1.5 inches from the rear edge 18 of the boot 10.

Referring to FIG. 2, one possible embodiment of the sole 14 defines grooves, notches, or detents 58*a*–58*c* in the inside surface. The grooves 58*a*–58*c* are sized and configured to receive the carbon strips 47*a*–47*c*, respectively, so that the top surface of the carbon strips 47*a*–47*c* are about even with the inner surface 36 of the sole 14. An advantage of this configuration is that it will reduce wear of the carbon strips 47*a*–47*c*. Although grooves 58*a*–58*c* are shown, other embodiments are possible. In one embodiment, for example, the inner surface 36 of the sole 14 is substantially planer and the insert 40 rests on top of the inner surface 36.

Many alternative embodiments of the present invention are possible. One such embodiment, for example, has either a full or a partial carbon inner sole in place of the H-shaped insert 40. Other configurations of the tail 50 are also possible. In one embodiment, the tail 50 is not configured to extend into the person's shoe. The tail 50 is only configured to be connected to the coveralls. The person would then wear a separate grounding strap. In other possible embodiments, the tail 50 has a configuration other than an elongated strip.

Another possible embodiment uses an electrically conductive fabric other than that having a conductive grid 24 woven into the fabric. Conductive materials other than carbon also can be used if they provide favorable resistance characteristics. One such embodiment might use an electrically conductive adhesive in lieu of carbon threads. Yet another alternative embodiment uses fastening methods and structures other than snaps.

Alternative embodiments of the sole 14 are also possible. For example, one embodiment uses material other than Chemstat 939™ brand material to form the sole 14. Additionally, the sole 14 might be molded to have some portions that are conductive and other portions that are not conductive. Another possible embodiment uses the same fabric to form the sole 14 and the upper 12. Any type of material that has favorable resistive characteristics can be used for the sole 14.

In use, a worker will position the tail 50 of the insert 40 into their shoe. If there is adequate moisture in the shoe, the tail 50 can be positioned outside of the person's sock. The moisture will provide an adequate path for the static or electrical charges to flow from the person's body to the insert 40. Alternatively, the person can position the tail 50 on the inside of their sock so that there is direct contact between the tail 50 and the person's skin. The person then slips their shoe into the boot 10 and places the leg of their coveralls into the cuff 20 of the boot 10. At least two of the boot snaps 28*a*–28*f* are connected to snaps on the coverall leg thereby providing an electrical path between the upper portion 12 of the boot 10 and the coverall.

Additionally, the insert snap 52 is connected to a snap on the leg of the coverall. The insert snap 52 provides an electrical path from the coverall to the insert 40. The person can then freely walk around the clean room, or other work environment. So long as the worker has one foot on the ground they will remain grounded to the floor.

Alternative methods of using a boot 10 that embodies the present invention are possible. In one alternative method, for example, of use the person will put his/her foot directly into the boot 10 without wearing a shoe. In another possible method, the insert 40 is not snapped to the coveralls. Another possible method snaps the insert 40 to the coveralls, but does not place the insert 40 into electrical communication with the persons' foot.

Although the description of the various embodiments and methods have been quite specific, it is contemplated that modifications could be made without deviating from the spirit of the present invention. Accordingly, it is intended that the scope of the present invention be dictated by the appended claims, rather than by the description of the various embodiments and methods.

The claimed invention is:

1. A boot comprising:

an upper portion;

a sole having upper and lower surfaces, the sole being operably connected to the upper portion and configured to provide an electrical path from the upper surface to the lower surface, the sole and the upper portion forming a heel portion;

an insert having a first portion in electrical communication with the upper surface of the sole and a second portion configured to project upward from the upper surface of the sole; and wherein the first portion of the insert has an H-shape with an elongated strip, a forward cross-member, and a rear cross-member, the rear cross-member being proximal to the heel.

2. The boot of claim 1 wherein the sole has a side wall, the forward cross-member has oppositely disposed end portions, and the rear cross-member has oppositely disposed end portions, the oppositely disposed end portions of the forward and rear cross-members extending upward along the side wall of the sole.

3. The boot of claim 2 wherein the oppositely disposed end portion of the forward and rear cross-members are fastened to the side wall of the sole.

4. The boot of claim 3 wherein the oppositely disposed end portions are stitched to the side wall of the sole with an electrically-conductive thread.

5. The boot of claim 3 wherein the only portion of the insert that is fastened to the sole is the oppositely-disposed end portions.

6. The boot of claim 3 wherein the inner surface of the sole defines grooves and the elongated strip, forward cross-member, and rear cross-member are positioned in the grooves.

7. The boot of claim 1 further comprising a tail extending from the insert.

8. The boot of claim 7 wherein the length of the tail is between about 20 inches and about 36 inches.

9. The boot of claim 8 further comprising a snap operably connected to the tail portion.

10. The boot of claim 1 wherein the insert is formed with carbon material.

11. A boot comprising:

an upper portion formed from an electrically conductive material;

a sole having upper and lower surfaces, the sole being operably connected to the upper portion and configured to provide an electrical path from the upper surface to the lower surface; and an insert having a first portion in electrical communication with the upper surface of the sole and a second portion configured to project upward from the upper surface of the sole.

12. The boot of claim 11 wherein the upper is in electrical communication with the sole.

13. The boot of claim 11 further comprising at least one snap operably connected to the upper.

14. A boot comprising:

an upper portion formed from an electrically conductive material;

a sole operably connected to the upper portion, the sole being formed from an electrically conductive material; and an insert having a first portion in electrical communication with the sole and a second portion configured to project upward from the sole.

15. The boot of claim 14 wherein the insert is adjoining the sole.

* * * * *